US007481461B2

(12) United States Patent
McGarian et al.

(10) Patent No.: US 7,481,461 B2
(45) Date of Patent: Jan. 27, 2009

(54) DEVICE WHICH IS EXPANDABLE TO ENGAGE THE INTERIOR OF A TUBE

(75) Inventors: Bruce McGarian, Aberdeen (GB); Gary Pape, Nisku (CA); Tony LaPlante, Aberdeen (GB)

(73) Assignee: Smith International, Inc., Houston, TX (US)

( * ) Notice: Subject to any disclaimer, the term of this patent is extended or adjusted under 35 U.S.C. 154(b) by 75 days.

(21) Appl. No.: 11/415,430

(22) Filed: May 2, 2006

(65) Prior Publication Data

US 2006/0273584 A1 Dec. 7, 2006

(30) Foreign Application Priority Data

May 3, 2005 (GB) ..... 0509029.5

(51) Int. Cl.
*F16L 27/00* (2006.01)

(52) U.S. Cl. ..... 285/145.1; 285/298; 285/302; 285/332; 285/398; 285/921; 166/207; 166/242.7

(58) Field of Classification Search ..... 285/145.1, 285/298, 302–303, 332, 382.4, 398, 921; 166/207, 242.7

See application file for complete search history.

(56) References Cited

U.S. PATENT DOCUMENTS 3,776,307 A * 12/1973 Young ..... 166/125
3,948,321 A * 4/1976 Owen et al. ..... 166/277

FOREIGN PATENT DOCUMENTS

WO 2005121622 12/2005

* cited by examiner

*Primary Examiner*—Aaron M Dunwoody
*Assistant Examiner*—Fannie Kee
(74) *Attorney, Agent, or Firm*—Dykema Gossett PLLC

(57) ABSTRACT

A device which is expandable to engage the interior of a tube, for example the casing of an oil well, comprises first and second tubular members in partial telescopic engagement with each other, the first tubular member having an end region which is received on the second tubular member and which is expandable radially outwardly to engage the interior of the tube. The second tubular member has tapered regions which, when forced into the end region, will cause radial expansion of the end region. The taper angle of the second tapered zone is less than the taper angle of both the first tapered zone and the third tapered zone. The fourth tapered zone preferably has a taper angle which is greater than that of the second tapered zone and less than that of the third tapered zone. In one embodiment, the tapered zones have respective taper angles of 15°, 1°, 5° and 1.25°.

14 Claims, 2 Drawing Sheets

DEVICE WHICH IS EXPANDABLE TO ENGAGE THE INTERIOR OF A TUBE

BACKGROUND OF THE INVENTION

1. Field of the Invention

This invention relates to a device which is expandable to engage the interior of a tube in which the device is located. The device, when expanded, may form a mechanical interference fit with the tube, in which case it can function as an anchor. Alternatively or additionally the device may form a seal with the interior of the tube. To this end, the device may include an elastomeric member or coating to engage the interior of the tube. If the device, when expanded, forms a seal with the interior of the tube, it may function as a packer. If it forms both a mechanical interference fit and a seal it may serve as a packer anchor. The device of the present invention has particular application in the oil and gas industry where it may be used as an anchor, a packer or a packer anchor (according to its configuration) inside tubing located in an oil or gas well. It is to be understood, however, that the invention is not limited to such applications and embodiments of the present invention may be applicable to a wide range of circumstances where it is necessary either to form a mechanical interference fit with the interior tube and/or to form a seal with the interior tube.

2. The Prior Art

Anchors, packers and packer anchors are well known within the oil and gas industry. A design of packer anchor which has the advantage of a particularly thin-walled configuration is described in our co-pending United Kingdom patent application 0417765.5, the contents of which are incorporated herein by reference. The packer anchors described in that application each comprise an outer tubular member which is expandable into engagement with the interior of a tube in which the member is located, and a swage which is forced into the outer tubular member during setting in order to expand the outer tubular member as required. The present invention is concerned with improvements in the design of such swage-actuated anchors, packers or packer anchors.

SUMMARY OF THE INVENTION

In accordance with the first aspect of the present invention there is provided a device which is expandable to engage the interior of a tube in which the device is located, the device comprising: first and second tubular members in partial telescopic engagement with each other, the first tubular member having an end region which is received on the second tubular member and which is expandable radially outwardly to engage the interior of the tube, and the second tubular member having a tapered region which, when forced into the end region, will cause radial expansion of the end region, the tapered region having first, second and third tapered zones having respectively first, second and third taper angles, the tapered zones being located to enter the end region successively when the tapered region is forced into the end region with the first tapered zone entering the end region before the second tapered zone and the second tapered zone entering the end region before the third tapered zone, wherein the taper angle of the second tapered zone is less than the taper angle of the first tapered zone and is less than the taper angle of the third tapered zone.

Preferably, the taper angle of the first tapered zone is greater than the taper angle of the third tapered zone.

The provision of a relatively low taper angle second tapered zone between the first tapered zone and the third tapered zone has been found to improve the setting characteristics of the device. Improvements noted include a reduction in the force necessary to effect setting of the device and an improved consistency in the setting force required to set nominally identical devices. The reduced setting force and improved consistency of setting force are of particular advantage in a multi-packer device such as that described in the above mentioned GB0417765.5, but may have applications in other arrangements of single or multiple anchors, packers or packer anchors.

In the preferred embodiment the second tubular member includes a fourth tapered zone located on the side of the third tapered zone remote from the second tapered zone. In the preferred embodiment of the invention the fourth tapered zone has a taper angle which is greater than that of the second tapered zone, and the third tapered zone has a taper angle which is greater than that of both the second tapered zone and the fourth tapered zone.

The invention will be better understood from the following description of a preferred embodiment thereof, given by way of example only, reference being had to the accompanying drawings.

DETAILED DESCRIPTION OF THE PREFERRED EMBODIMENTS

Figure 1:
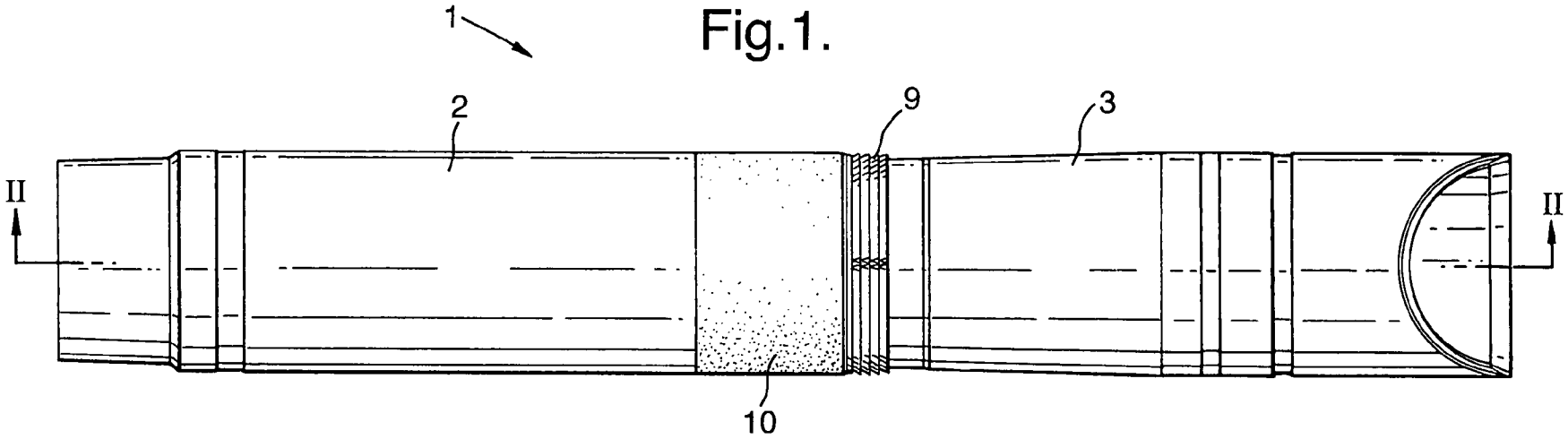
FIG. 1 illustrates schematically in side view an embodiment of device in accordance with the present invention.
Figure 2:
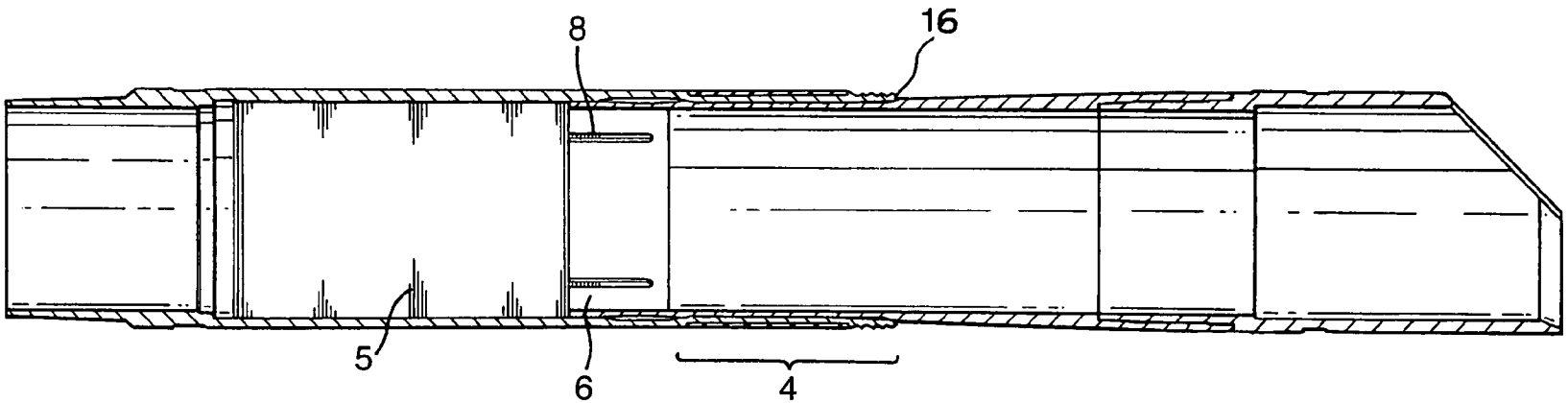
FIG. 2 is a cross-section of FIG. 1 along the line II-II of FIG. 1.
Figure 3:
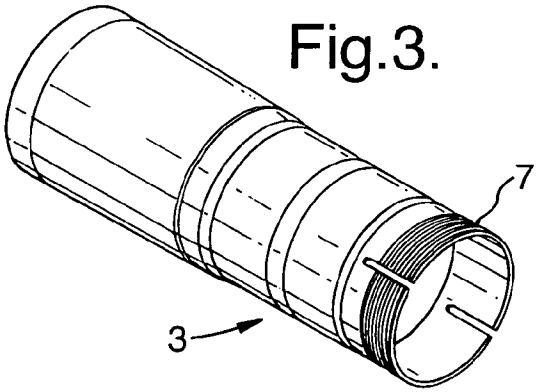
FIG. 3 is an isometric view of the second tubular member of the embodiment of FIGS. 1 and 2.

Referring to the drawings, the illustrated device 1 comprises a first tubular member 2 and a second tubular member 3. In FIGS. 1 and 2 the tubular members are illustrated in their assembled but unset condition. In this condition the two tubular members are partially telescopically engaged with an end region 4 of the first tubular member received on a portion of the second tubular member. The interior of the first tubular member is formed with a plurality of ratchet teeth 5. The exterior of an end region 6 of the second tubular member is formed with complementary ratchet teeth 7. The inherent resilience of the material of the second tubular member (typically steel) maintains the ratchet teeth 7 of the second tubular member in engagement with the ratchet teeth 5 of the first tubular member. Application of sufficient mechanical force to telescope the two tubular members together (as described in more detail below) will cause the ratchet teeth 7 of the end region 6 to ride over the ratchet teeth 5 of the first tubular member but thereafter to resist telescopic movement of the tubular members in the opposite direction.

As described in more detail in the aforesaid GB0417765.5, by suitable selection of the characteristics of the tubular members, for example the wall thickness of the end region 6 and/or the number of slots 8 provided in the end region, the force necessary to telescope the tubular members together can be adjusted.

The end region 4 of the first tubular member includes a serrated region 9 which, when the end region 4 has been expanded into contact with a surrounding tube, will form a mechanical interference fit with the tube. Adjacent the serrated region 9 a resiliently deformable packer rubber 10 is mounted on the first tubular member. In use, after the serrated region 9 has been expanded into engagement with the surrounding tube continued movement of the second tubular member 3 into the first tubular member 2 will cause expansion of the packer rubber 10 into sealing engagement with the surrounding tube. Accordingly, the device illustrated in the drawing may be regarded as a packer anchor.

Figure 4:
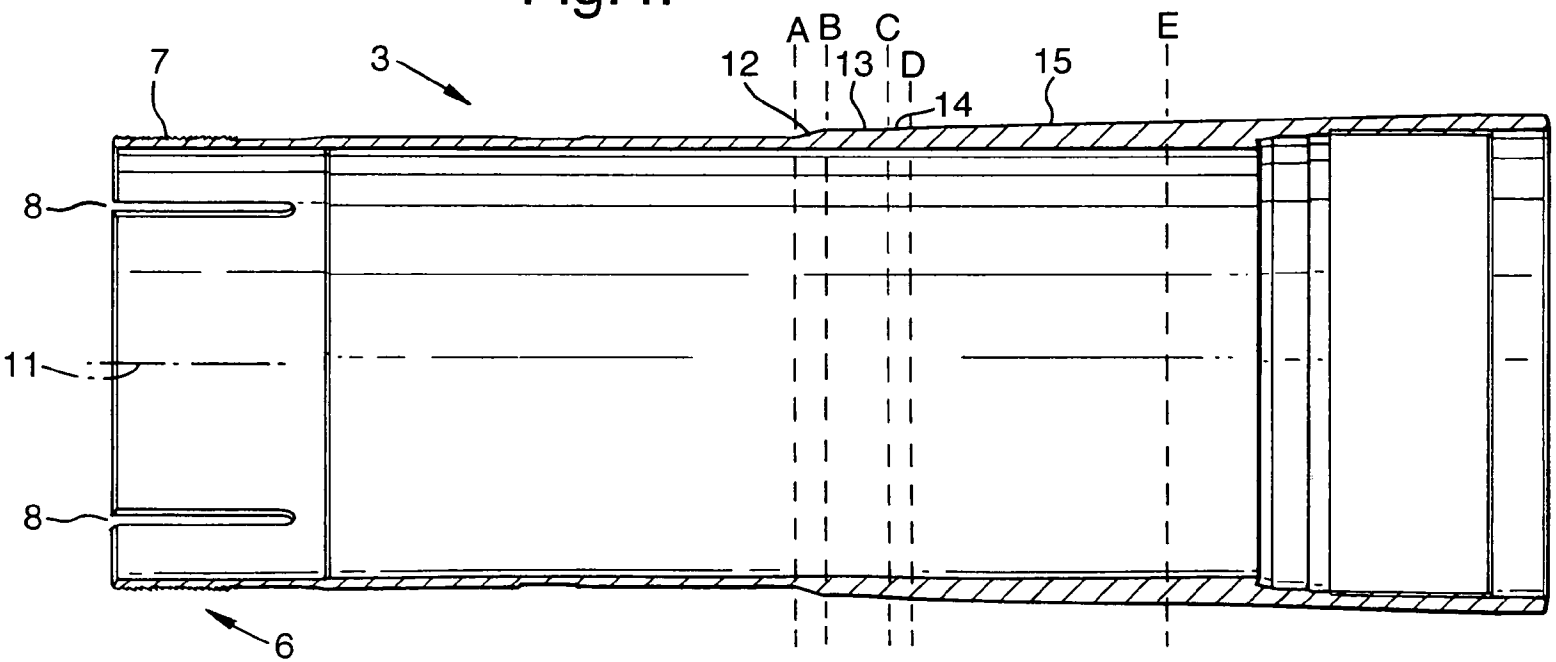
FIG. 4 is a longitudinal cross-section of the second tubular member of the embodiment of FIGS. 1 and 2.

Referring now to FIG. 4, the structure of the second tubular member 3 is shown in greater detail. Five planes, A, B, C, D and E each of which extends perpendicular to the longitudinal axis 11 of the second tubular member are marked on FIG. 4. The exterior surface of the second tubular member 3 between the planes A and B forms a first tapered zone 12 having a first taper angle. The exterior surface of the second tubular member 3 between the planes B and C forms a second tapered zone 13 having a second taper angle. The exterior surface of the second tubular member 3 between the planes C and D forms a third tapered zone 14 having a third taper angle. The exterior surface of the second tubular member 3 between the planes D and E forms a fourth tapered zone 15 having a fourth taper angle. The tapered zones 12, 13, 14 and 15 are each substantially frustoconical in shape and the "taper angle" of each zone is half the included angle formed at the apex of the cone of which each respective tapered zone forms a frustum.

In accordance with the present invention the taper angle of the second tapered zone 13 is less than the taper angle of the first tapered zone 12 and is less than the taper angle of the third tapered zone 14. In a particular embodiment of the invention the taper angle of the first tapered zone 12 is 15°, the taper angle of the third tapered zone 14 is 5° and the taper angle of the second tapered zone 13 is 1°. It is to be understood, however, that these numerical values are given by way of example only and a wide range of values of the taper angles may be selected in light of the particular requirements of the system in question. In the preferred embodiment the taper angle of the fourth tapered zone is 1.25° and accordingly the taper angle of the second tapered zone is also less than the taper angle of the fourth tapered zone, and the taper angle of the third tapered zone is greater than the taper angle of both the second tapered zone and the fourth tapered zone.

In use, the first tubular member and second tubular member are assembled to the configuration shown in FIGS. 1 and 2. In this configuration there has been no expansion of the end region 4 and the leading edge 16 of the first tubular member 2 is in light contact with or spaced a small distance from the first tapered zone 12. The diameter of the second tubular member at the plane B is such that forcing the second tubular member into the first tubular member will cause an initial radial expansion of the end region 4 as the first tapered zone 12 moves along the length of the end region 4.

As the second tubular member 3 is forced into the first tubular member 2 the expansion of the end region 4 which was initiated by the first tapered zone 12 will be continued by the second tapered zone 13, the third tapered zone 14 and the fourth tapered zone as these zones successively enter the first tubular member. As noted above, it has been found that the provision of a second tapered zone 13 having a taper angle of less than those of both the first tapered zone and the third tapered zone 14 reduces the setting force required to fully expand the end region 4 and renders the setting force required more consistent across a range of nominally identical devices.

The taper angle of the second tapered zone 13 may be selected in accordance with design criteria between 0° (parallel) and the taper angle of the third tapered zone 14.

The invention claimed is:

1. A device which is expandable to engage the interior of a tube in which the device is located, the device comprising: first and second tubular members in partial telescopic engagement with each other, the first tubular member having an end region which is received on the second tubular member and which is expandable radially outwardly to engage the interior of the tube, and the second tubular member having an external tapered region which, when forced into the end region, will cause radial expansion of the end region, the tapered region having first, second and third tapered zones having respectively first, second and third taper angles, the tapered zones being located to enter the end region successively when the tapered region is forced into the end region with the first tapered zone entering the end region before the second tapered zone and the second tapered zone entering the end region before the third tapered zone, wherein the taper angle of the second tapered zone is less than the taper angle of the first tapered zone and is less than the taper angle of the third tapered zone.

2. A device according to claim 1, wherein the taper angle of the first tapered zone is greater than the taper angle of the third tapered zone.

3. A device according to claim 2, wherein the end region of the first tubular member carries a resiliently deformable packer seal mounted on the first tubular member and expandable into engagement with a tube surrounding the device to form a seal therewith.

4. A device according to claim 1, wherein the second tubular member includes a fourth tapered zone located on the side of the third tapered zone remote from the second tapered zone.

5. A device according to claim 4, wherein the fourth tapered zone has a taper angle which is greater than that of the second tapered zone.

6. A device according to claim 5, wherein the third tapered zone has a taper angle which is greater than that of both the second tapered zone and the fourth tapered zone.

7. A device according to claim 4, wherein the taper angle of the fourth tapered zone 1.25°.

8. A device according to claim 1, wherein the taper angle of the second tapered zone is 0° (parallel).

9. A device according to claim 1, wherein the tapered angle of the second tapered zone is greater than 0° (parallel) and less than 5°.

10. A device according to claim 9, wherein the taper angle of the second tapered zone is 1°.

11. A device according to claim 1, wherein the taper angle of the first tapered zone is 15°.

12. A device according to claim 1, wherein the taper angle of the third tapered zone is 5°.

13. A device according to claim 1, wherein inter-engaging ratchet teeth provided respectively on the first and second tubular members co-operate to permit telescopic movement of the second tubular member into the first tubular member but resist telescopic movement of the tubular members in the opposite direction.

14. A device according to claim 1, wherein the end region of the first tubular member includes a serrated region for forming a mechanical interference fit with the tube in which the device is located.

* * * * *